United States Patent [19]

Shanin

[11] 4,210,333

[45] Jul. 1, 1980

[54] PUZZLE CUBES FOR FORMING RECTANGULAR PARALLELEPIPEDS

[76] Inventor: Steven R. Shanin, 6460 N. Lincoln Ave., Highland Park, Ill. 60645

[21] Appl. No.: 927,003

[22] Filed: Jul. 24, 1978

[51] Int. Cl.[2] ..... A63F 9/12

[52] U.S. Cl. ..... 273/157 R

[58] Field of Search ..... 273/157 R

[56] References Cited

FOREIGN PATENT DOCUMENTS 675678 7/1952 United Kingdom ..... 273/157 R

*Primary Examiner*—Anton O. Oechsle

*Attorney, Agent, or Firm*—Larson, Taylor and Hinds

[57] ABSTRACT

A puzzle device includes a plurality of cubes. Each cube has visual matter on a plurality of its faces. The cubes are arrangeable at least twice in a pre-determined way into a rectangular parallelepiped with the cubes in adjacency and with their exposed faces forming at least five of the six sides of the parallelepiped. Each cube is unique, with respect to its visual matter, with respect to all other cubes, and the visual format on the cubes is such that in each pre-determined arrangement, the exposed faces of the cubes together form a pre-determined visual format. For example, a set of cubes is arrangeable in three different ways into a parallelepiped thus providing a total of fifteen different visual formats, one on each of the four sides and top of the parallelepiped formed by arrangement of the cubes.

2 Claims, 8 Drawing Figures

FIG. 1
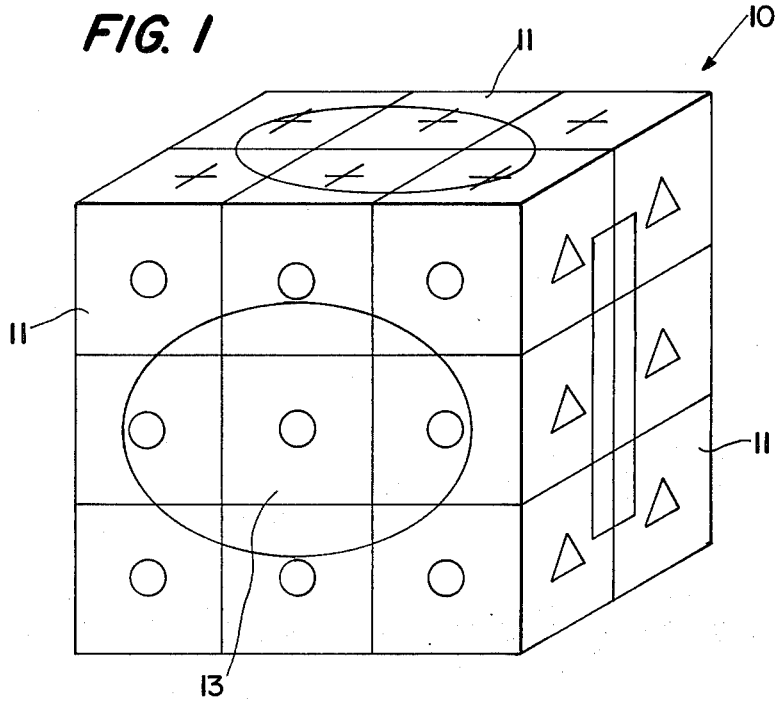
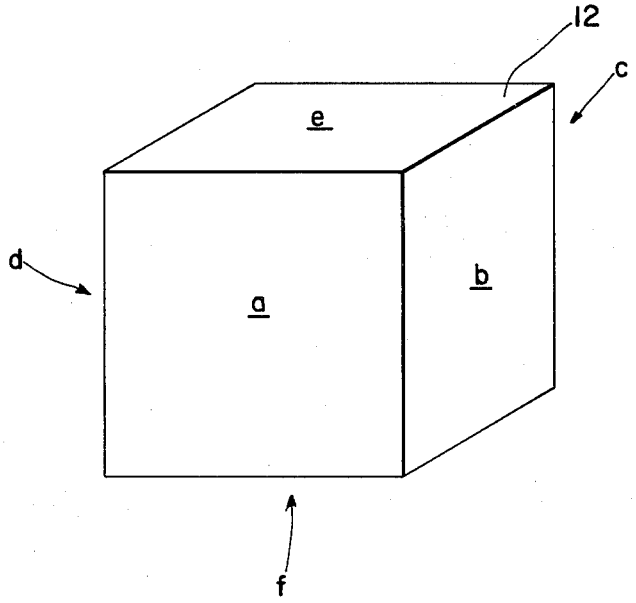
FIG. 2

PUZZLE CUBES FOR FORMING RECTANGULAR PARALLELEPIPEDS

BACKGROUND OF THE INVENTION

The present invention relates to a puzzle, game, or amusement device of the type involving rearrangement of the cubes into a rectangular parallelepiped in different ways to provide different pre-determined visual formats formed by the exposed faces of the cubes. While many such devices which involve rearrangeable cubes have been described in the prior art, such as in U.S. Pat. No. 3,771,795, the present invention has many unique differences and advantages thereover as will be apparent from the description which follows.

BRIEF SUMMARY OF THE INVENTION

In accordance with the present invention, a puzzle device includes a plurality of cubes, each cube having visual matter on a plurality of its faces. The cubes are arrangeable in at least two different pre-determined ways into a rectangular parallelepiped with the cubes in adjacency and with their exposed faces forming at least five of the six sides of the parallelepiped. Each of the cubes is unique in the visual matter on its faces with respect to all other cubes. The visual format on the cubes is such that in each pre-determined arrangement, the exposed faces of the cubes together form a pre-determined visual format on at least five sides of the parallelepiped.

DESCRIPTION OF THE DRAWINGS

FIG. 1 is a perspective view of an assembly of cubes constituting a puzzle device according to the invention;

FIG. 2 is a perspective view of an individual cube used in the cube assembly of FIG. 1;

DETAILED DESCRIPTION

Figure 3:
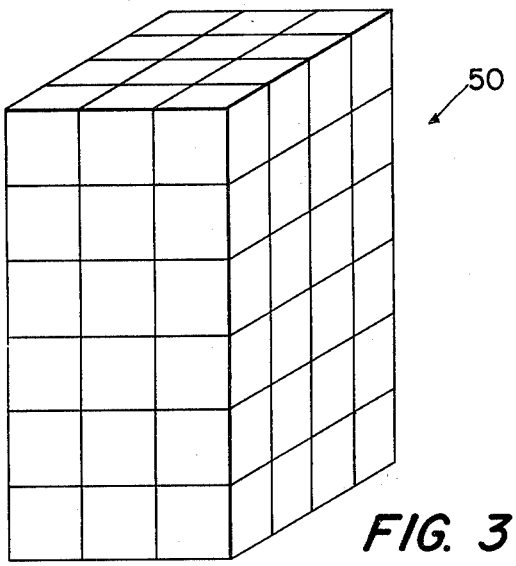
FIG. 3 is a perspective view of a further assembly of cubes constituting a further puzzle arrangement according to the invention.
Figure 4:
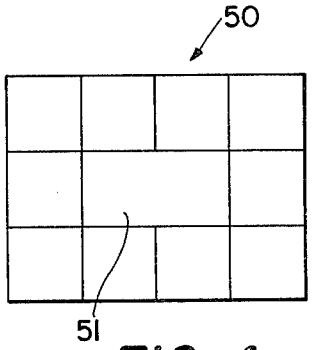
FIG. 4 is a bottom view of the arrangement of FIG. 3.
Figure 5:
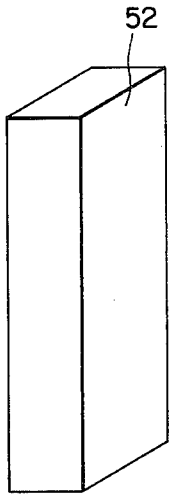
FIG. 5 is a perspective view of a support structure for the arrangement of FIG. 3.
Figure 6:
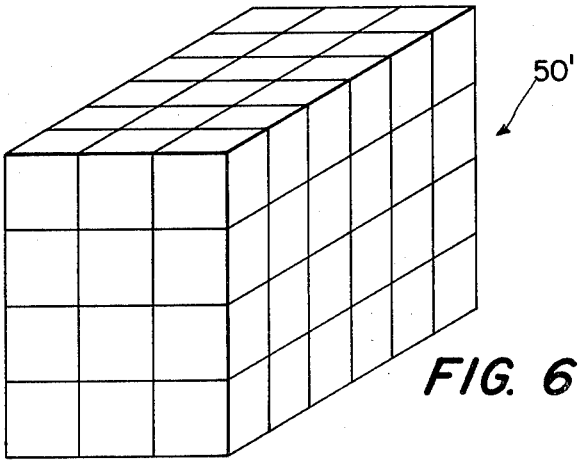
FIG. 6 is a perspective view of a different assembly of the cubes of FIG. 3.
Figure 7:
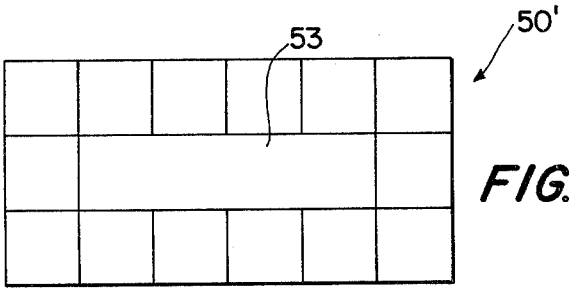
FIG. 7 is a bottom view of the arrangement of FIG. 6.
Figure 8:
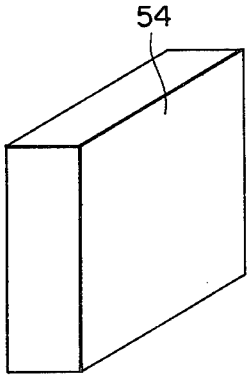
FIG. 8 is a perspective view of a support structure for the arrangement of FIG. 6.

A puzzle device 10 in accordance with the invention and made up of eighteen individual cubes 11 is shown in FIG. 1. The cubes are formed into a rectangular parallelepiped three cubes high by three cubes wide by two cubes deep as shown with six faces or sides (i.e. the top, bottom and four vertical sides). The front and rear sides each have nine cube faces exposed and the right, top and left sides each have six faces exposed, a total of thirty six faces. The eighteen cubes have a total of one hundred and eight faces. When placed on a horizontal surface, the assembled cubes present five exposed sides (top and four vertical sides). Each of the exposed cube faces is provided with pre-determined visual matter which may be a picture, design, or the like. For purposes of illustration, geometrical designs are shown on the front, top and right sides of the cube assembly of FIG. 1. When the cubes are properly arranged in a pre-determined manner, the pre-determined visual matter appears on each of the five exposed sides of the assembled cubes. The visual matter on each of the exposed sides is different from that on each other side. For example, each side may present a different geometrical design such as shown in FIG. 1. Pictorial matter may also be used. In any event, while each side has a different visual format, those formats may be related as to subject matter. For example, front, rear, left side, right side and top views of a subject, such as a person, a building, or the like may be used.

In accordance with the invention, the cubes are arrangeable in at least two, different, pre-determined ways into a rectangular parallelepiped with the cubes in adjacency and with their exposed faces forming at least five of the six sides thereof. One arrangement of the eighteen cube embodiment (three sides shown) is shown in FIG. 1 and it will be understood that each of its five sides (top and four vertical sides) is provided with a pre-determined visual format different from that on each of the other sides. This represents a first arrangement of the cubes. In the embodiment of FIG. 1, two other, totally different five sided visual formats can be made by rearranging the cubes into the same size and shape parallelepiped. How this is achieved will be understood with reference to FIG. 1 in which there are eighteen cubes having a total of one hundred and eight faces. When arranged as shown, thirty six cube faces are exposed on the top and four sides, and seventy two cube faces are obscured. The second five sided visual format arrangement is provided by rearranging the cubes in such a manner that thirty six of the previously obscured faces are exposed. The third five sided visual format arrangement is provided by rearranging the cubes a thrid time such that the remaining thirty six faces, previously obscured in the first and second arrangements, are exposed and, in this arrangement, the thirty six faces used for the first arrangement, and the thirty six faces used for the second arrangement, are obscured. Cube rearrangement may be done, with reference to FIG. 1, as follows. In each of the three arrangements, each of the four top corner cubes has three exposed faces and three obscured faces. Two cubes used in the front and back sides have only one exposed face. The remaining ten cubes each have two exposed faces. It will be understood, therefore, that a cube used as a top corner cube in the first arrangement cannot be used again in that manner since two arrangements would use all six faces and one of those six faces would, therefore, necessarily be exposed in the third arrangement. Accordingly, some thought must be given to cube rearrangement. In the illustrated embodiment, assuming the cubes to be numbered 1 through 18, cube rearrangement will be apparent from the following analysis:

| | First Arrangement | | Second Arrangement | | Third Arrangement | |
|---|---|---|---|---|---|---|
| Cube No. | Cube Faces Used | Cube Faces Unused | Cube Faces Used | Cube Faces Unused | Cube Faces Used | Cube Faces Unused |
| 1 | 3 | 3 | 2 | 1 | 1 | 0 |
| 2 | 3 | 3 | 2 | 1 | 1 | 0 |
| 3 | 3 | 3 | 2 | 1 | 1 | 0 |
| 4 | 3 | 3 | 2 | 1 | 1 | 0 |
| 5 | 2 | 4 | 1 | 3 | 3 | 0 |
| 6 | 2 | 4 | 1 | 3 | 3 | 0 |
| 7 | 2 | 4 | 1 | 3 | 3 | 0 |
| 8 | 2 | 4 | 1 | 3 | 3 | 0 |

-continued

| Cube No. | First Arrangement Cube Faces Used | First Arrangement Cube Faces Unused | Second Arrangement Cube Faces Used | Second Arrangement Cube Faces Unused | Third Arrangement Cube Faces Used | Third Arrangement Cube Faces Unused |
|---|---|---|---|---|---|---|
| 9 | 2 | 4 | 2 | 2 | 2 | 0 |
| 10 | 2 | 4 | 2 | 2 | 2 | 0 |
| 11 | 2 | 4 | 2 | 2 | 2 | 0 |
| 12 | 2 | 4 | 2 | 2 | 2 | 0 |
| 13 | 2 | 4 | 2 | 2 | 2 | 0 |
| 14 | 2 | 4 | 2 | 2 | 2 | 0 |
| 15 | 1 | 5 | 3 | 2 | 2 | 0 |
| 16 | 1 | 5 | 3 | 2 | 2 | 0 |
| 17 | 1 | 5 | 3 | 2 | 2 | 0 |
| 18 | 1 | 5 | 3 | 2 | 2 | 0 |
| Total | 36 | 72 | 36 | 36 | 36 | 0 |

Rearrangement will be further understood with reference to rerrangement of a single cube 12 which is illustrated in FIG. 2 and which has faces identified as "a" through "f". It will be assumed that, in the first arrangement, cube 12 is the top right cube on the front side 13 of the cube arrangement of FIG. 1 with face "a" forward and face "e" up. Faces "a", "b", and "e" are thus used in the first cube arrangement. In the second arrangement, any two adjacent unused faces may be used (see list above) such as faces "c" and "d", leaving face "f" unused. Thus, the cube in question can be used in any of the ten cube positions in the second arrangement which require the use of two cube faces. For example, it could be used as the bottom right cube in the sense of FIG. 1. In the third arrangement, the single remaining face, face "f" can be used as any of the four cubes requiring only a single exposed face. For example, the central cube on front side 13.

The cubes can be made of any suitable material such as plastic, paperboard, cardboard or the like. Preferably, the cubes are fabricated of a material, such as paperboard, which is printed as a blank which can be folded along suitable fold lines to form a cube. Slots and tabs, glue tabs, and the like, may be provided to secure the cube in its folded, cubical, configuration. Solid blocks, of course, can also be used. The puzzle arrangement of FIG. 1 can be made as follows. Eighteen cubes of identical size, for example, one cubic inch, are made up from any suitable blank material such as paperboard. The cubes are then arranged as shown in FIG. 1. A first visual format, covering the five sides of the cube assembly, is then selected. The visual format extends over the top and four vertical sides of the assembly and is preferably made up of five distinct sub-formats, one for each of the five sides. For purposes of illustration, it will be assumed that five photographs, top, front, rear, left side and right side views of an object or person, are selected for presentation. The front photograph, equal in size and shape to front side 13 of the cube assembly, is cut into nine squares, each having the same size as the cube faces exposed in side 13. The cut picture squares are then glued or otherwise secured in proper position onto the exposed cube faces such that the selected front view photograph is presented on side 13 of the cube assembly. The four remaining photographs are similarly worked up on the remaining four sides, right side view on the right side, and so forth. The second visual format, again made up of five separate views, is then selected. The cubes are then rearranged in an appropriate manner, such as set forth above, and the five views of the second visual format are applied to the rearranged cube assembly in the same manner. The cubes are then rearranged into the third and final arrangement and the third visual format is applied in the same manner.

The cubes may conveniently be marked with an appropriate code, such as fine lines at a cube edge, so that one knowing the code can readily assemble the cubes into one or more of the three pre-determined cube arrangements.

It is preferred that the device be capable of mass production. This is readily accomplished in the embodiment described above by unfolding the cubes to which the three visual formats have been attached, and printing sets of eighteen cube blanks, preferably partially cut, such that the device can be packaged and sold in a relatively flat package and the cubes first "punched out" and then assembled by the user. As mentioned above, the cubes could be coded to facilitate assembly and the code could be made available to a user.

It will be recognized that the mathematical possibilities of the puzzle device are very high. Accordingly, and particularly where the visual subject matter is complex, an extraordinary degree of difficulty in assembling the puzzle is possible. In this regard, it should be pointed out that it is not at all necessary, in rearranging the cubes, to proceed in the particular fashion mentioned above. While there are some constraints on rearrangement (for example, a cube once used in the FIG. 1 assembly to expose three faces simultaneously must be subsequently used once to expose only one face and once to expose only two faces) a good deal of random rearrangement is possible if the number of cubes is high. For example, using eighteen cubes as in FIG. 1, cube number 9 can be used in any one of six places in any of the three arrangements.

It is a significant feature of the present invention that each cube in the assembly is unique, with respect to its visual format, with respect to all other cubes in the assembly. Thus, a much greater degree of difficulty in assembling the puzzle is possible than in other systems such as that of U.S. Pat. No. 3,771,795, in which not all cubes are thus unique. Further, in the present invention, it is possible that the visual format on each face of each cube is unique with respect to all other cube faces in the assembly and this feature renders the invention capable of an extraordinarily high degree of difficulty. Of course, the degree of difficulty can be rendered less by reducing the number of cubes, by choice of visual format, by the use of common background colors or texture, and by other means well known to those of ordinary skill in the art.

While the illustrated embodiment is made up of eighteen cubes and can provide three, five-sided visual formats, many others are possible, some of which are as follows:

| Number of Cubes | Format: Four sides and Top — Cube Arrangement H | W | D* | Number of Arrangements | Format: Four sides, top and bottom — Cube Arrangement H | W | D* | Number of Arrangements |
|---|---|---|---|---|---|---|---|---|
| 4 | 1 | 2 | 2 | 2 | | | | |
| 8 | | | | | 2 | 2 | 2 | 2 |

-continued

| Number of Cubes | Format: Four sides and Top — Cube Arrangement H | W | D* | Number of Arrangements | Format: Four sides, top and bottom — Cube Arrangement H | W | D* | Number of Arrangements |
|---|---|---|---|---|---|---|---|---|
| 16 | 2 | 2 | 4 | 3 | | | | |
| 18 | 3 | 3 | 2 | 3 | | | | |
| 20 | 2 | 5 | 2 | 2 | | | | |
| | | and | | | | | | |
| | 5 | 2 | 2 | 1 | | | | |
| 24 | 2 | 4 | 3 | 1 | | | | |
| | | and | | | | | | |
| | 6 | 2 | 2 | 1 | | | | |
| 27 | | | | | 3 | 3 | 3 | 3 |
| 32 | 2 | 4 | 4 | 4 | | | | |
| 36 | 2 | 6 | 3 | 4 | | | | |
| 36 | 3 | 4 | 3 | 4 | | | | |
| 36 | | | | | 3 | 6 | 2 | 3 |
| 56 | 3 | 6 | 4 | 3 | | | | |
| 72 | 6 | 6 | 2 | 4 | | | | |

*H = # of cubes in height
*W = # of cubes in width
*D = # of cubes in depth

A somewhat different result is achieved with a parallelepiped 50 of sixty two cubes arranged six high by three wide by four deep, with the cubes disposed only at the other surface of the rectangular parallelepiped. The hollow central space 51, volume five cubes high, one cube wide, and two cubes deep, may be occupied with blank cubes or a properly shaped support 52. The sixty two cube assembly provides for two five sided arrangements in the generally vertical configuration described and for two additional five sided configurations 50', where assembled generally horizontally four high by three wide by six deep. Sixty cubes are needed for the second configuration and the two extra cubes can be placed in the central, unused portion 53 of the parallelepiped which, in this configuration, is a volume three cubes high, one cube wide, and four cubes deep. Again, this volume may be occupied with blank cubes or a support structure 54 provided for the purpose. This embodiment is advantageous in providing for two different overall shapes—one vertical, one horizontal—for different formats which adds to the aesthetic quality of the puzzle. A similar change in configuration is possible with other cube assemblies, such as the twenty cube assembly and the twenty four cube assembly included in the foregoing list. Each is capable of arrangement with five sided formats of generally horizontal and generally vertical configuration. In these assemblies, however, and in all of the assemblies in the list above, except the 56 cube set, all of the cubes are utilized in the parallelepiped structure: there is no hollow central volume. In the 56 cube set, the cubes are disposed at the top and vertical sides only, as in the 62 cube set described above.

In order to provide a sufficient degree of flexibility and design difficulty, it is preferred to use a minimum of sixteen cubes arrangeable into at least three visual formats.

A base plate or the like may be provided as a support on which the cubes can be assembled. In the case of a six sided format, the support may be a transparent element which will permit viewing of the bottom side. A box-like enclosure encompasing several sides, even all six sides, may also be provided so that the cube assembly may be moved about. In that event, each side of the box enclosure located above a side having visual format may be transparent for viewing with the enclosure in position.

What is claimed is:

1. A puzzle device consisting of sixty two cubes, each cube having visual matter on a plurality of its faces, the cubes being arrangeable, using all sixty two cubes, in two different pre-determined ways into a first rectangular parallelepiped six cubes high by three cubes wide by four cubes deep with the exposed cube faces forming the sides and top of the parallelepiped, and arrangeable, using sixty of the cubes, into two still different pre-determined ways into a second parallelepiped four cubes high by three cubes wide by six cubes deep with the exposed cube faces forming the sides and top of the parallelepiped, each cube being unique in the visual matter on its faces, with respect to all other cubes, the visual format on said cubes being such that in each of said pre-determined arrangements, the exposed faces of the cubes together form a pre-determined visual format on the five sides of the parallelepiped, whereby twenty different pre-determined visual formats may be provided, one on each of the five sides of the rectangular parallelepiped formed by arrangement of the cubes.

2. A puzzle according to claim 1 wherein the visual format on each cube face is unique with respect to the visual format on all other cube faces.

* * * * *